US006801731B2

(12) United States Patent
Parker

(10) Patent No.: US 6,801,731 B2
(45) Date of Patent: Oct. 5, 2004

(54) PRE-FLIGHT ESTIMATION OF COST FOR PRINT JOBS

(75) Inventor: Abbie Jo Parker, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 13 days.

(21) Appl. No.: 10/202,927

(22) Filed: Jul. 25, 2002

(65) Prior Publication Data

US 2004/0018027 A1 Jan. 29, 2004

(51) Int. Cl.[7] ..... G03G 21/02
(52) U.S. Cl. ..... 399/79
(58) Field of Search ..... 399/79, 80, 81, 399/82, 83

(56) References Cited

U.S. PATENT DOCUMENTS 5,383,129 A * 1/1995 Farrell ..... 705/400
5,636,032 A 6/1997 Springett
5,794,094 A 8/1998 Boockholdt et al.
5,825,986 A 10/1998 Ferguson
5,850,584 A * 12/1998 Robinson et al. ..... 399/79
5,937,225 A 8/1999 Samuels
5,986,658 A 11/1999 Prouty
6,052,547 A 4/2000 Cuzzo et al.
6,064,838 A * 5/2000 Maruta et al. ..... 399/79
6,128,448 A 10/2000 Arcaro et al.
6,149,327 A 11/2000 Ward et al.
6,173,295 B1 1/2001 Goertz et al.
6,574,443 B1 * 6/2003 Butikofer et al. ..... 399/79

* cited by examiner

*Primary Examiner*—Robert Beatty

(57) ABSTRACT

Methods and apparatus for providing pre-flight estimation of costs associated with a print job. Knowledge of the expected cost of a print job prior to generating the tangible output is useful for education of the user, cost control by the user, tracking by the user or administrator, etc. Cost estimates are generated from cost variables and their multipliers based on the desired output prior to generating the tangible output. Certain embodiments utilize the image page description to determine the type and quantity of consumable items needed to produce the tangible output. Using unit cost information associated with these consumables, an estimated cost of the tangible output can be determined. Certain additional embodiments further utilize the image page description to determine the type and quantity of overhead items needed to produce the tangible output to factor in the costs of increased utilization and/or maintenance of the destination imaging device.

21 Claims, 4 Drawing Sheets

PRE-FLIGHT ESTIMATION OF COST FOR PRINT JOBS

FIELD OF THE INVENTION

The present invention relates generally to pre-flight estimation of cost for print jobs.

BACKGROUND

Imaging devices are found in a vast number of computer networks and personal computer setups. Imaging devices include printers, plotters, multi-function devices and other devices used for applying an image to a tangible print media, such as paper, transparencies, card stock and more. The image is applied to the print media using a marking material, e.g., ink, ribbon, toner, or other means of applying an image to the print media.

The image data is typically generated by some user application in a device external to the imaging device. An example includes composing an image in a graphics application of a computer workstation, generating image data in the graphics application and communicating the image data to a networked or local printer to produce a hard copy of the document.

When a tangible output image is desired, the image data is converted into a form usable by the destination imaging device. One method is to provide the image data in the form of a page description. A page description is a data structure providing information on how to recreate the desired image. A variety of high-level page description languages (PDLs) can be used to generate page descriptions for use by the imaging device. These PDLs are often device-independent languages, i.e., the same image data can be provided to devices of differing types and/or differing manufacturers to produce an end result that is substantially the same. Examples of PDLs include Printer Command Language or PCL (Hewlett-Packard Company, Palo Alto, Calif., USA), PostScript® (Adobe Systems Incorporated, San Jose, Calif., USA) and Interpress (Xerox Corporation, Stamford, Conn., USA).

To process these PDLs, imaging devices have what is often referred to as a formatter. The formatter has a processor that is responsive to a control program to convert the image data to a printable image. The control program typically provides interpretation of the PDLs, character generation, device emulation, etc. The printable image is typically uncompressed raster or bitmap information that is supplied to another component of the imaging device, often referred to as an engine. The engine controls the mechanical components of the imaging device to produce a tangible output, such as a hardcopy of the printable image. Although it is common to perform the page description interpretation at the imaging device, host-based solutions are available to process a page description at the source device. An example includes SuperPrint (Zenographics, Incorporated, Irvine, Calif., USA), which accepts native GDI (graphical display interface) page descriptions and rasterizes them at the host device. These host-based solutions generally present the image data to the imaging device in the form of the printable image, eliminating the need for further processing at the imaging device.

In requesting a print job, or generation of the tangible output image, a user is often presented with a variety of options. Some of these options include a choice of destination imaging devices, a choice of print media, a choice of resolution, a choice of color, etc. Each of these choices is associated with an economic outcome.

For the reasons stated above, and for other reasons stated below that will become apparent to those skilled in the art upon reading and understanding the present specification, there is a need in the art for alternative methods and apparatus for providing economic feedback to an imaging device user or administrator.

SUMMARY

The various embodiments described herein provide pre-flight estimation of costs associated with a print job, i.e., before sending the print job to its destination imaging device. Knowledge of the expected cost of a print job prior to generating the tangible output is useful for education of the user, cost control by the user, tracking by the user or administrator, etc. Cost estimates are generated from cost variables and their multipliers based on the desired output prior to generating the tangible output. Certain embodiments utilize the image page description to determine the type and quantity of consumable items needed to produce the tangible output. Using unit cost information associated with these consumables, an estimated cost of the tangible output can be determined. Certain additional embodiments further utilize the image page description to determine the type and quantity of overhead items needed to produce the tangible output to factor in the costs of increased utilization and/or maintenance of the destination imaging device.

Further embodiments of the invention include methods and apparatus of varying scope.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Figure 1:
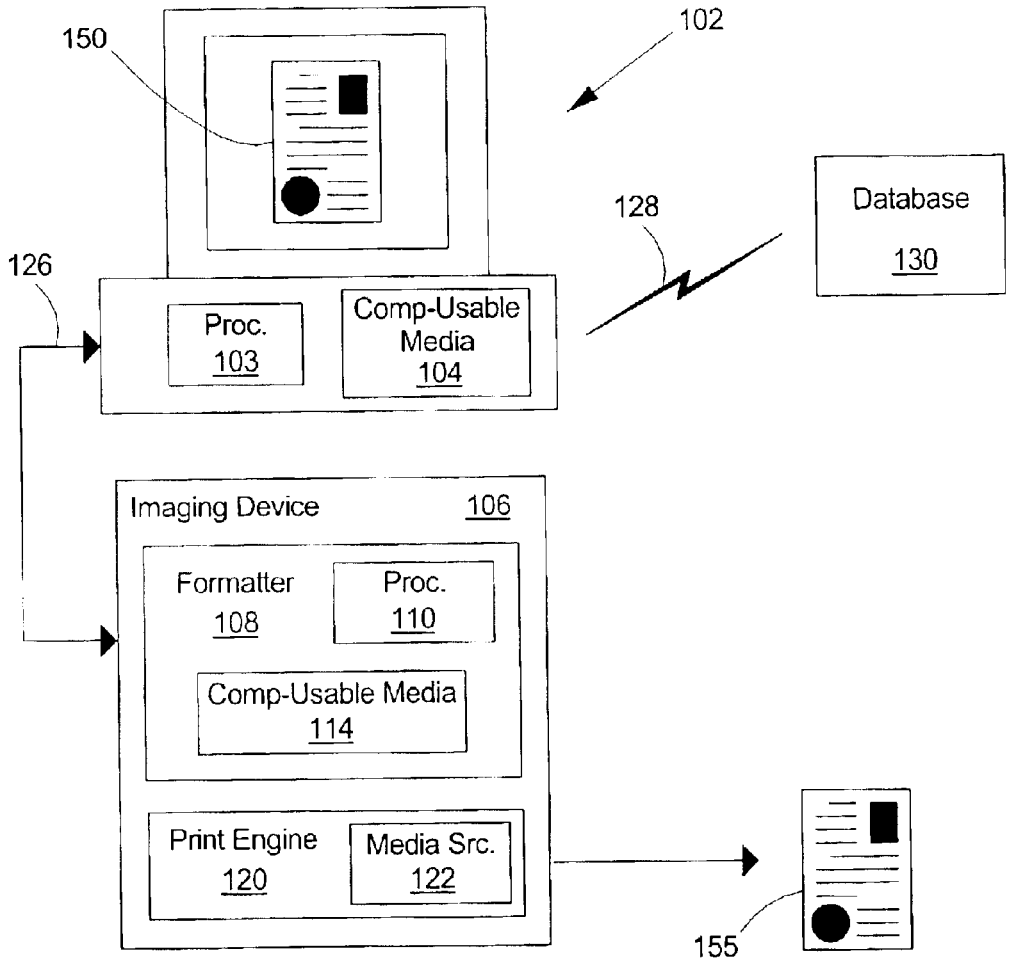
FIG. 1 is a simplified schematic of an imaging system in accordance with an embodiment of the invention.

FIG. 1 is a simplified schematic of an imaging system in accordance with an embodiment of the invention. The imaging system includes a processor-based device 102 for storing or generating a desired image 150, and an imaging device 106 for generating a tangible output image 155 representative of the image 150.

The processor-based device 102 is any device used for storing or generating a desired image 150, i.e., a source device. Examples include a personal computer, workstation, network server or other processor-based device. The image 150 can represent anything within the imagination of the user, whether it be text, a drawing, a photograph or some other image. The processor-based device 102 of FIG. 1 includes a processor 103 and a computer-usable media 104 in communication with the processor 103. The processor 103 generates an image page description of the image 150 for producing the desired output image 155. The image page description is provided to an imaging device 106 via a communication link 126. The link 126 may be a hard-wired link or a wireless link. It may be a direct connection between the processor-based device 102 and the imaging device 106 or it may represent a number of connections through a network, including passing through another device, such as a network server or router. Examples of link 126 include one or more of a parallel communication link, a serial communication link, a Universal Serial Bus (USB) connection, an IR (infrared) communication link and other such wired and wireless communication links. These communication links are typically adapted for bi-directional communications.

The processor 103 is adapted to perform methods in accordance with embodiments of the invention in response to computer-readable instructions. These computer-readable instructions are stored on the computer-usable media 104 and may be in the form of either software, firmware or hardware. As a whole, these computer-readable instructions are often termed a device driver, translating the image data into a format usable by a device or class of devices. In a hardware solution, the instructions are hard coded as part of a processor, e.g., an application-specific integrated circuit (ASIC) chip. In a software or firmware solution, the instructions are stored for retrieval by the processor 103. Some additional examples of computer-usable media include static or dynamic random access memory (SRAM or DRAM), read-only memory (ROM), electrically-erasable programmable ROM (EEPROM or flash memory), magnetic media and optical media, whether permanent or removable. Most consumer-oriented computer applications are software solutions provided to the user on some removable computer-usable media, such as a compact disc read-only memory (CD-ROM).

The imaging device 106 has a formatter 108 for interpreting the image page description and rendering the image data into a printable image. The formatter 108 includes a processor 110 and computer-usable media 114. Similar to the processor 103 of the processor-based system 102, the processor 110 of the formatter 108 is adapted to interpret the image page description and render the image data in response to computer-readable instructions stored on the computer-usable media 114. In addition, the computer-usable media 114 may be used to store the image page description for access by the processor 110. Guidelines for the computer-usable media 114 are substantially the same as the computer-usable media 104. Computer-readable instructions for operation of a processor may be stored on a read-only type of media, but data representative of the image page description must generally be stored on a rewritable type of media. Accordingly, the computer-usable media 104 and the computer-usable media 114 may each represent one or more types of media, e.g., both DRAM and flash memory.

The printable image is provided to a print engine 120 to produce a tangible output image 155 on a print media. The print engine 120 represents the mechanical aspects of the imaging device 106. The print engine 120 further includes a media source 122 for supplying the print engine 120 with the print media. Examples of the source 122 include media trays or by-pass feeders.

When requesting generation of the tangible output image 155, a user is often presented with choices regarding where the tangible output image should be generated, i.e., the destination imaging device, as well as other choices, such as the desired type of print media, color or black & white, the desired resolution, the desired print density, etc. As different imaging devices often have differing capabilities, many of the choices are limited or defined by the choice of destination imaging device. A cost conscious user may desire to know the economic ramifications of the choices made, or an administrator of the imaging devices may want the user to be aware of such costs. The various embodiments facilitate providing economic feedback on the estimated cost of producing the output image prior to actual generation of the tangible output. This requires knowledge of the cost variables of consumables, e.g., unit cost of the various types of print media, unit cost of the various types of marking material, unit cost of fasteners for binding multiple sheets of the print media, etc. For one embodiment, the knowledge of the cost variables of overhead items are also considered, e.g., replacement of expendable device components (organic photoconductors, print heads, fuser oil rollers, corona wires, etc.), additional device wear for printing on two sides of the print media, additional time required for collating, binding or other special handling, additional device wear expected from printing high-density images, etc. While these overhead items may be of little concern to an end user, an administrator of the imaging device may want to associate a cost with such overhead items for education of the user.

For one embodiment, the cost variables are contained in a database 130 in communication with the processor-based device 102. FIG. 1 depicts the database 130 as an external database in communication with the processor-based device 102 via communication link 128. As with the link 126 between the processor-based device 102 and the imaging device 106, the link 128 may be a hard-wired or wireless link, coupled either directly or through a network. As one example, the external database 130 is a database contained on a server of a network containing the processor-based device 102 and the imaging device 106. In this manner, an administrator can update a single source for their enterprise without the need for providing the cost variables to each user. There are a variety of network administration tools, such as Web JetAdmin (Hewlett-Packard Company, Palo Alto, Calif., USA), that could be used for managing such an external database. Alternatively, the external database 130 is a web-based database. For example, a manufacturer of the imaging device 106 may provide standard cost information available through Internet access. While this would not be expected to be as accurate as a database maintained by a local or network administrator, where actual inventory costs could be provided, it may be sufficient for the needs of many users. For another embodiment, the database of cost variables is contained locally on the computer-usable media 104 of the source device 102. For a further embodiment, the database contained locally to the source device 102 is incorporated into the driver for the imaging device 106, such as a look-up table within the driver software. For yet another embodiment, the database of cost variables is contained locally on the computer-usable media 114 of the destination imaging device 106. As one example, embedded web servers are provided by many imaging device manufacturers. These embedded web servers allow users to access device-specific information via an IP address. Typical uses include status updates on consumables life, event logs, job accounting (what users have printed how many pages), etc. This is often used by smaller business IT persons and could be one place to house cost variables local to the imaging device 106. Such a local database could also be used by an administrator to store and retrieve historical cost information on documents that have already been printed.

The database 130 may be populated manually, such as by an end user or administrator, or it may be populated automatically, such as from a purchasing or inventory database containing the appropriate cost information. The database 130 may contain discrete unit cost information, e.g., a cost per sheet of print media, variable unit cost information, e.g., a formula for the cost per unit area of marking material, or a combination of discrete and variable cost information. Also, the database 130 may contain actual costs, e.g., an inventory cost of the print media, estimated costs, e.g., an average cost per page for marking material at an assumed density and percent coverage, or a combination of actual and estimated cost information. For example, it is common in the industry to quote the expected life of consumable based on a 5% coverage for a black & white page or a 20% coverage (5% each for C, M, Y and K) for a color page. These expected life assumptions could be used to create an estimated cost per page of output for such consumables. Although each type and/or grade of consumable is associated with its own unit cost, a user, administrator or other owner of the database may choose to assign the same value of unit cost to more than one type/grade of a consumable.

Figure 2:
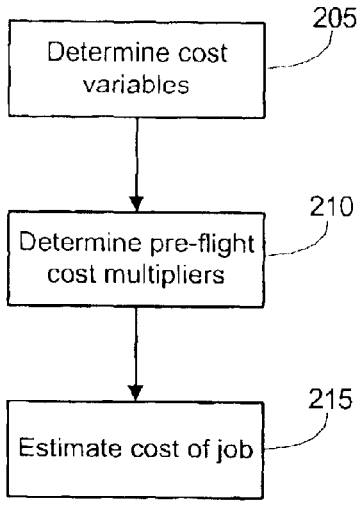
FIG. 2 is a flowchart of a method of estimating the costs associated with generating a tangible output image in accordance with an embodiment of the invention.

FIG. 2 is a flowchart of a method of estimating the costs associated with generating a tangible output image in accordance with an embodiment of the invention. At 205, cost variables are determined. Using the example of a typical business situation, a user may desire to print a letter from a word processing application to a laser printer. The consumables needed to produce the letter include primarily the desired print media and the laser toner. As such the cost variables include the unit costs of the desired print media and the laser toner. These cost variables may take a variety of forms. Print media is perhaps best defined in terms of cost per sheet in the case of sheet stock or cost per unit length in the case of roll stock. Marking material is generally more complex as the dispensed or applied volume is difficult to measure directly. One solution would be to express the cost variable in terms of cost per page of output at 100% coverage. Another would be to express the cost variable in terms of cost per page of output without regard to actual or expected coverage. In general, this approach would need to factor in an assumed percent coverage, i.e., it would represent the cost of the marking material divided by the expected number of pages of output produced during typical or historical usage.

At 210, the pre-flight cost multipliers are determined. Continuing with the example, the letter may be three pages long. This may include one page on letterhead stock and two pages on plain bond stock. The cost multipliers would thus be one for the letterhead stock and two for the plain bond stock, provided the-cost variables for both types of print media are expressed in terms of cost per sheet. If the marking material cost variable is expressed in terms of cost per page of output without regard to actual or expected coverage, its cost multiplier would be three, i.e., the total number of pages. However, the expected coverage of marking material is discernible from the image data. The application utilized to generate the image, in this case the word processor, contains sufficient information to determine the expected coverage. Appropriately modified, the source application could provide this information. Alternatively, the expected coverage can be determined from the image page description. Estimating coverage is elementary and is not of itself part of this invention. For example, coverage estimation can take the form of counting the number of pixels in an image, sending the image page description through a raster image processor to determine an expected number of firings of a print head or to determine the size of the raster image data, determining the size of the image page description in relation to the number of pages of output, referring to look-up tables by type of image element contained in the output, etc. Note that while improving accuracy of the coverage estimation will generally lead to improved cost estimates for the desired print job, rough estimates will often be sufficient for most user's needs.

Once the cost variables and cost multipliers are determined, the cost of the print job is estimated at 215 by multiplying the cost multipliers by their respective unit costs. Although the method depicted in FIG. 2 shows determining the cost variables prior to determining the cost multipliers, their order may be switched.

Figure 3:
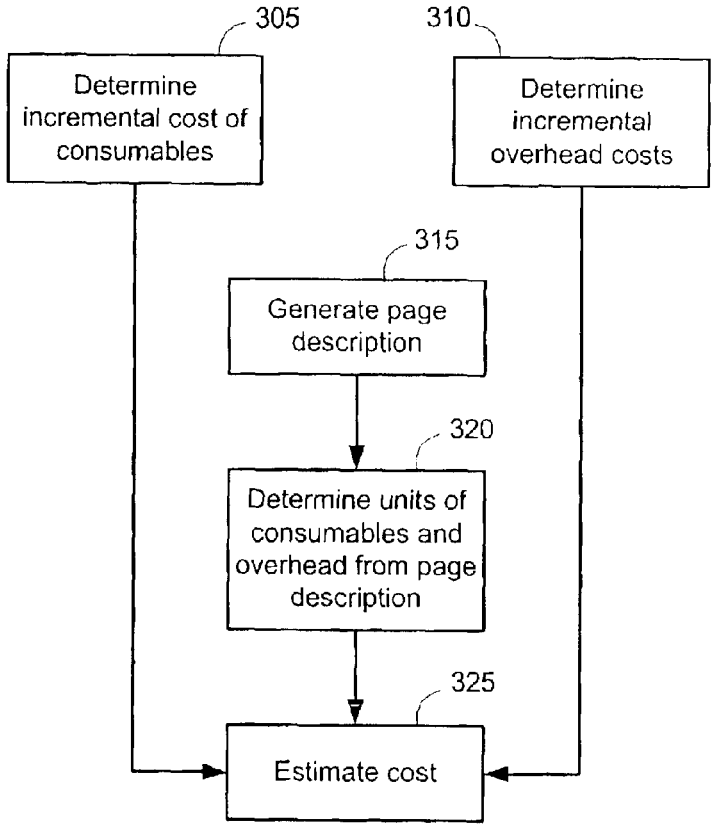
FIG. 3 is a flowchart of a method of estimating the costs associated with generating a tangible output image in accordance with another embodiment of the invention.

FIG. 3 is a flowchart of a method of estimating the costs associated with generating a tangible output image in accordance with another embodiment of the invention. At 305, the incremental cost of consumables in determined, such as by retrieving the information from the database. Optionally, the incremental overhead costs are determined at 310. Similarly to the consumable costs, the overhead costs may be retrieved from the database.

At 315, an image page description is generated. This is the information needed to reproduce the desired image in a tangible form, whether it is to be processed at the destination imaging device or at the source device. The image page description contains, among other information, information from which the type and quantity of print media, the type and quantity of marking material, the type and quantity of other necessary consumables, and the type and quantity of any special handling may be discerned. Accordingly, from this image page description, the number of units of the various consumables and overhead items is determined at 320. The cost of producing the tangible output image is then estimated at 325 as a sum of the products of the number of units and their incremental costs. If cost variable information is unavailable or incomplete, or if a user simply wants to perform a "what if" analysis, the user could be prompted or otherwise allowed to populate or modify the database manually at the time of the request. This user-supplied cost variable information could be stored for future print requests or discarded after completion of the print request. The cost estimate may take a variety of forms. For example, the cost estimate may be a total cost for the job, a cost for each page of the job, or an average cost per page of the job.

Figure 4:
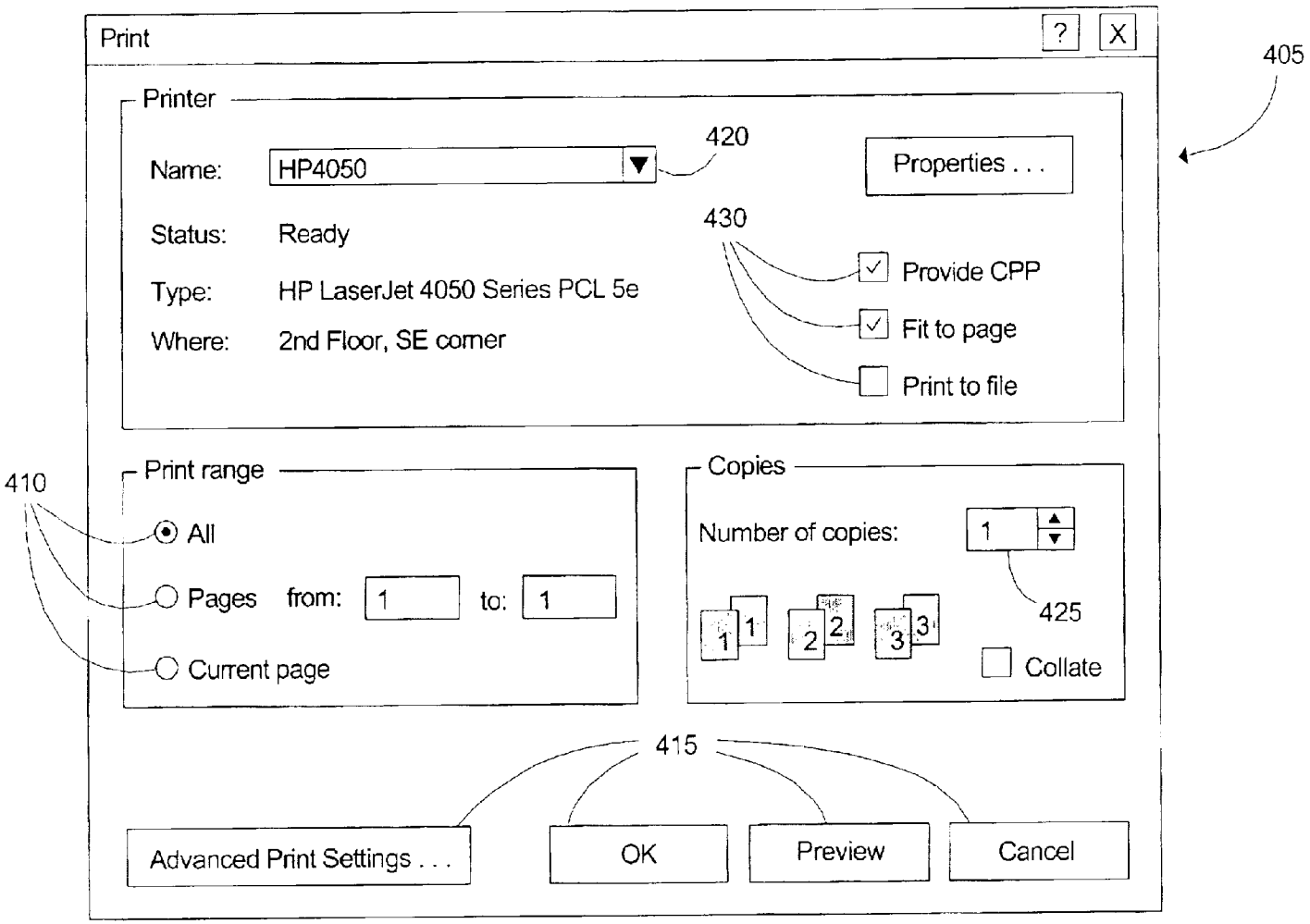
FIG. 4 is an example of a print window in accordance with an embodiment of the invention.

FIG. 4 is an example of a print window in accordance with an embodiment of the invention. It is common in many consumer and business computer applications that a user is presented with options in response to a print request. Although this presentation may take any form, it is often in the form of a pop-up window 405 such as the one shown in FIG. 4. Such windows typically have a number of elements. Examples include option buttons 410 for selecting one option from a number of options, command buttons 415 for initiating an action in response to a selection, drop-down boxes 420 for selecting an item from a list of items, scroll boxes 425 for adjusting a number of some item and check boxes 430 for toggling certain options. A typical computer user is well familiar with the use of such windows in setting parameters for a print job. The window 405 further includes the option, such as through a check box 430, to provide a CPP (cost per page) in response to activating the OK command button 415. Accordingly, while the driver for the destination imaging device can be adapted to provide cost information in response to every print request, alternatively the user can be provided with the option to print with or without receiving cost information. Furthermore, where the user is provided with the option, providing cost information may be defined as a default value such that it will be performed in response to every print request unless the user intervenes and chooses to forego this information.

Figure 5:
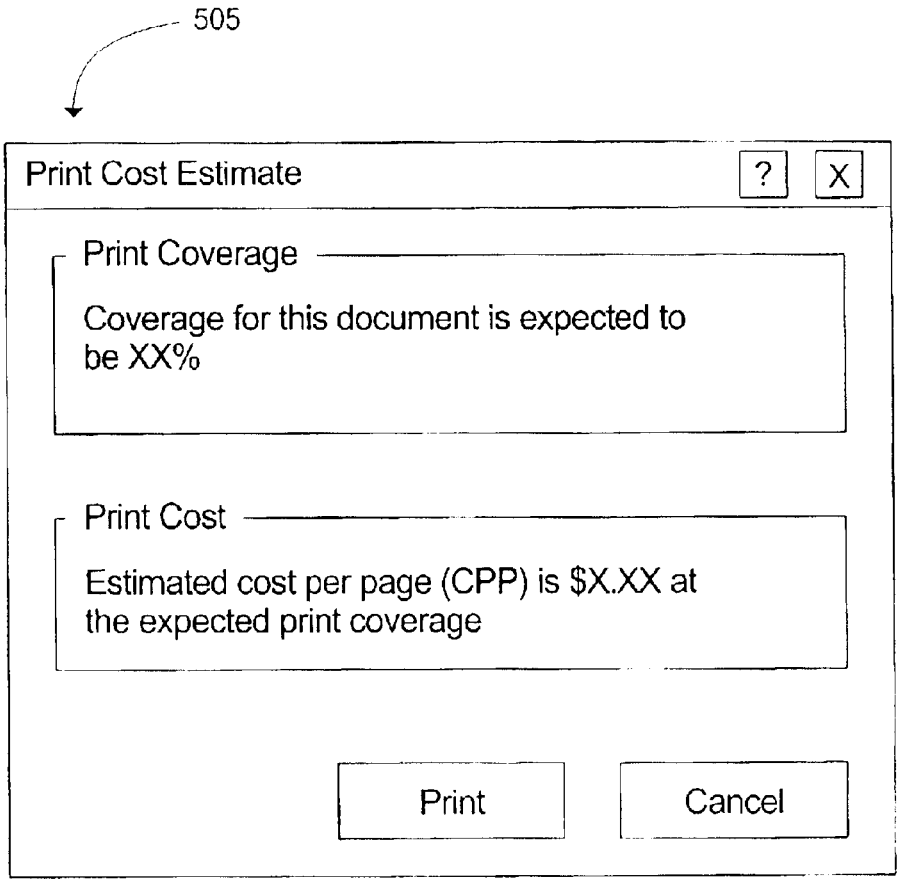
FIG. 5 is an example of a cost estimate window in accordance with an embodiment of the invention.

FIG. 5 is an example of a cost estimate window in accordance with an embodiment of the invention. The cost information may be presented to a user or administrator in a variety of formats. One example is a pop-up window 505. Window 505, in addition to providing cost information, optionally also provides information of the expected print coverage. Upon presenting the cost information, the user could be given the option to either print the job at the expected cost or cancel or otherwise return to allow the user to alter their print options to see their effect on cost. For one embodiment, the cost information is presented to the user in real time-as options are selected, such as on the print window 405 of FIG. 4. In this manner, the user may get immediate feedback on the cost of their various choices. In addition to presenting this information in a manner usable by the end user, e.g., a visual or audible display, the cost information of completed print jobs may be logged or tabulated for historical purposes of the user or an administrator. For networked environments, this historical cost information may be associated with the user generating the job, e.g., by location, department, device, or individual user.

CONCLUSION

The various embodiments provide pre-flight estimation of costs associated with a print job. Knowledge of the expected cost of a print job prior to generating the tangible output is useful for education of the user, cost control by the user, tracking by the user or administrator, etc. Cost estimates are generated from cost variables and their multipliers based on the desired output prior to generating the tangible output. Certain embodiments utilize the image page description to determine the type and quantity of consumable items needed to produce the tangible output. Using unit cost information associated with these consumables, an estimated cost of the tangible output can be determined. Certain additional embodiments further utilize the image page description to determine the type and quantity of overhead items needed to produce the tangible output to factor in the costs of increased utilization and/or maintenance of the destination imaging device.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A method of estimating cost associated with generating a tangible output image from a desired image, comprising:

selecting a destination imaging device;

determining cost variables associated with the desired image after selecting the destination imaging device, wherein the cost variables include at least one cost variable of a consumable and at least one cost variable of an overhead item;

determining cost multipliers for each of the cost variables; and estimating the cost associated with generating the tangible output image at the destination imaging device to include a sum of the products of the cost variables and their associated cost multipliers.

2. The method of claim 1, wherein determining cost variables further comprises retrieving unit cost information from a database.

3. The method of claim 2, wherein the database is contained on a device external from a processor-based device used for generating the desired image.

4. The method of claim 3, wherein the database is web-accessible.

5. The method of claim 2, wherein the database is accessible to a number of processor-based devices for use with estimating costs of producing tangible output images from any one of the processor-based devices.

6. A method of estimating cost associated with generating a tangible output image from a desired image, comprising:

determining cost variables associated with the desired image and a destination imaging device;

determining cost multipliers for each of the cost variables;

estimating the cost associated with generating the tangible output image at the destination imaging device to include a sum of the products of the cost variables and their associated cost multipliers; and dividing the estimated cost by a number of pages of output expected from the desired image, thereby generating an estimated cost per page of output.

7. A computer-usable media having computer-readable instructions stored thereon capable of causing a processor to perform a method, the method comprising:

determining a number of units of one or more consumables needed to generate a tangible output representative of a desired image from data representative of the desired image;

determining a number of units of one or more overhead items needed to generate the tangible output representative of the desired image from the data representative of the desired image;

determining a unit cost of each of the consumables and each of the overhead items; and estimating a cost to produce the tangible output of the desired image from the number of units of the consumables and the associated unit cost for each of those consumables and the number of units of the overhead items and the associated unit cost for each of those overhead items.

8. The computer-usable media of claim 7, wherein the method further comprises:

generating an image page description using a device driver associated with a destination imaging device; and determining a unit cost of each of the consumables from information contained in the device driver.

9. The computer-usable media of claim 8, wherein the information contained in the device driver is a look-up table of unit cost information.

10. The computer-usable media of claim 7, wherein the consumables comprise at least one item selected from the group consisting of print media and marking material.

11. The computer-usable media of claim 7, wherein the unit cost of a consumable accounts for a type and grade of the consumable.

12. A computer-usable media having computer-readable instructions stored thereon capable of causing a processor to perform a method, the method comprising:

determining a number of units of one or more consumables needed to generate a tangible output representative of a desired image from data representative of the desired image;

determining a unit cost of each of the consumables;

estimating a cost to produce the tangible output of the desired image from the number of units of the consumables and the associated unit cost for each of those consumables; and dividing the estimated cost by a number of pages of output expected for the tangible output, thereby generating an estimated cost per page of output.

13. A method of estimating a cost of a print job prior to sending the print job to a destination imaging device, the method comprising:

selecting the destination imaging device from a plurality of imaging devices of differing capabilities;

determining one or more consumables and one or more overhead items needed to produce a tangible output at the destination imaging device from an image page description representative of the print job, wherein the one or more consumables are limited by choices defined by the selected destination imaging device;

determining a quantity of each of the consumables and each of the overhead items needed to produce the tangible output;

determining a unit cost for each of the consumables and each of the overhead items needed to produce the tangible output; and estimating the cost of the print job from a sum of the products of the quantities of the consumables and their associated unit costs plus a sum of the products of the quantities of the overhead items and their associated unit costs.

14. The method of claim 13, further comprising:

determining a number of pages expected in the tangible output; and dividing the cost of the print job by the number of pages expected in the tangible output.

15. The method of claim 13, wherein determining the unit cost for each of the consumables and each of the overhead items needed to produce the tangible output occurs prior to generating the image page description representative of the print job.

16. The method of claim 15, wherein determining the unit cost for each of the consumables and each of the overhead items further comprises retrieving a unit cost from a database for each consumable and for each overhead item associated with the destination imaging device.

17. The method of claim 16, wherein the database is selected from the group consisting of a look-up table contained in a device driver for the destination imaging device and a database contained in an embedded web server of the destination imaging device.

18. A method of estimating a cost of a page of a print job prior to sending the print job to a destination imaging device, the method comprising:

selecting a destination imaging device from a plurality of destination imaging devices;

generating an image page description representative of the print job after selecting the destination imaging device;

determining one or more consumables and one or more overhead items needed to produce a page of tangible output at the destination imaging device from the image page description;

determining a quantity of each of the consumables and each of the overhead items needed to produce the page of the tangible output;

determining a unit cost for each of the consumables and each of the overhead items needed to produce the page of the tangible output; and estimating the cost of the page of the print job as a sum of the products of the quantities of the consumables and their associated unit costs plus a sum of the products of the quantities of the overhead items and their associated unit costs.

19. A method of estimating a cost of a print job, the method comprising:

requesting user input for parameters of the print job, wherein at least one parameter includes a selection of a desired destination imaging device for the print job;

generating an image page description representative of the print job and the parameters defined by the user;

estimating cost information for the print job from information contained in the image page description and a database of unit cost information, wherein the database of unit cost information includes unit cost information for at least one overhead item;

informing the user of the estimated cost information; and permitting the user to redefine the parameters of the print job in view of the estimated cost information prior to generating the print job.

20. The method of claim 19, wherein the parameters of the print job include at least one parameter selected from the group consisting of a selection of a desired destination imaging device for the print job, a selection of a type and grade of print media for each page of output of the print job, a selection of a type of marking material for use with the print job, a selection of a resolution of the print job, a selection of a density of marking material for use with the print job, and a selection of special handling of the print job.

21. A computer-usable media having computer-readable instructions stored thereon capable of causing a processor to perform a method, the method comprising:

receiving parameters for generating a tangible output of a desired image;

generating an image page description representative of the desired image and the parameters;

estimating cost information for generating the tangible output from information contained in the image page description and a database of unit cost information, wherein the database of unit cost information includes unit cost information for at least one overhead item;

displaying an indication of the estimated cost information;

permitting modification of the parameters after displaying the estimated cost information; and re-generating the image page description if the parameters are then modified.

* * * * *